United States Patent [19]

Miller

[11] 4,258,562

[45] Mar. 31, 1981

[54] PRESS STRUCTURE HAVING SHIFTABLE STOP

[75] Inventor: Donald E. Miller, Mt. Prospect, Ill.

[73] Assignee: The Continental Group, Inc., New York, N.Y.

[21] Appl. No.: 24,227

[22] Filed: Mar. 26, 1979

[51] Int. Cl.[3] ..... B21D 45/00

[52] U.S. Cl. ..... 72/344; 72/354

[58] Field of Search ..... 72/344, 345, 427, 354, 72/351, 347, 352, 358, 450, 453.01, 453.18

[56] References Cited

U.S. PATENT DOCUMENTS

| | | | |
|---|---|---|---|
| 2,417,794 | 3/1947 | Werner | 72/432 |
| 3,138,257 | 6/1964 | Andersen | 72/431 |
| 3,456,478 | 7/1969 | Alexander | 72/351 |

*Primary Examiner*—Lowell A. Larson
*Assistant Examiner*—Gene P. Crosby
*Attorney, Agent, or Firm*—Charles E. Brown

[57] ABSTRACT

A press structure wherein die pads are movable within die sleeves and wherein the die pads are recessed within the die sleeves initially for receiving material slugs. A suitable mechanism is provided which permits the die pads to be returned to positions beyond their starting positions so as to effect the complete removal of a formed article from its respective die sleeve to facilitate transverse removal of each formed tubular body. The stop mechanism next functions to move the die pad back to the original starting position ready to receive thereon another material slug.

10 Claims, 5 Drawing Figures

FIG.1
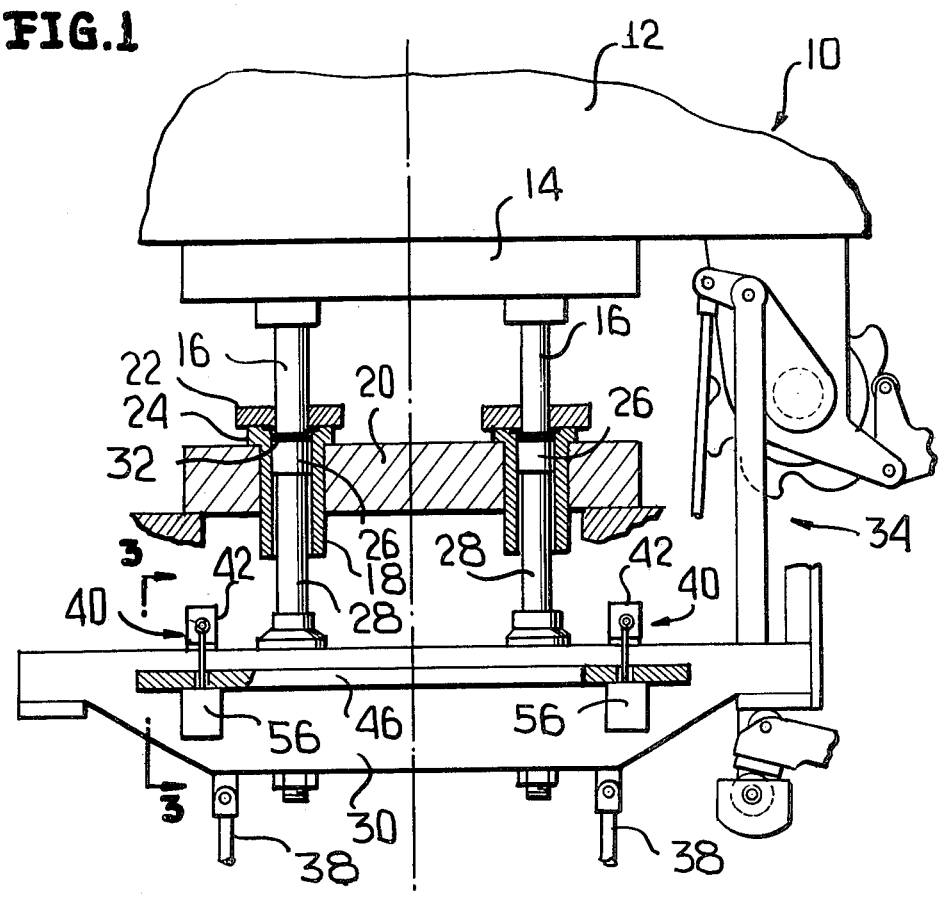
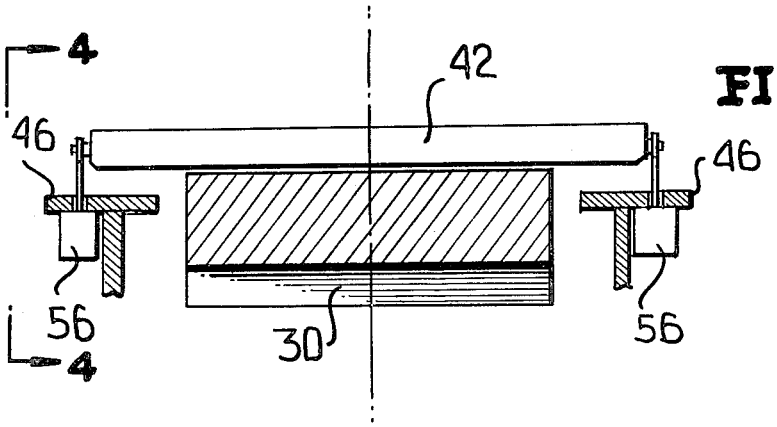
FIG.3

PRESS STRUCTURE HAVING SHIFTABLE STOP

This invention relates in general to new and useful improvements in press structures for forming tubular bodies wherein a slug of a material which may be extruded under pressure is placed within a die cavity defined by a fixed die sleeve and a movable die pad and engaged by a punch which, as the material extrudes, moves the die pad and the material down through the fixed die sleeve.

It is to be appreciated that in order that the material slug may be properly seated within the die assembly the die pad must be slightly recessed within the die sleeve at the time the slug is received. On the other hand, if the return travel of the die pad is such that it only returns to the slug receiving position, the tubular body formed by the die assembly is partially seated within the die sleeve and not susceptible to easy of removal, the removal thereof being limited initially axial movement.

In accordance with this invention, it is proposed to so mount the die pad so that on its return stroke it is moved axially beyond its recessed position for receiving the material slug and projects until it is at least coplanar with the upper end of the die sleeve so that a formed tubular body may be moved out of the die assembly in a transverse direction.

In accordance with this invention, the die pad is carried by a suitable support which may be in the form of a load beam which is coupled to the press ram in a manner not forming part of this invention to draw the press ram down and increase the pressure on the material slug between the punch and the die pad. Normally the load beam would be moved back to its original position against the fixed stop. However, with such a simple arrangement the die pad remains recessed within the die sleeve at all times and removal of a formed body in a transverse direction is prevented. It is therefore proposed to eliminate the fixed stop for the load beam and to provide a movable stop which permits the load beam, at the conclusion of the forming of a tubular body, to move upwardly beyond its starting position so as to move the die pad at least even with the top of the die sleeve so as to permit the last formed tubular body to be removed transversely off of the die pad. With this arrangement, the stop must be actuated to move the load beam and die pad downwardly to their initial positions after the last formed tubular body has been removed.

In accordance with this invention, the stop is permitted to be moved be the load beam an adjustable amount so as to obtain the desired positioning of the newly formed tubular body. Thereafter, one or more extensible fluid motors, which are constantly connected to the stop, are actuated so as to draw the stop down so as to return the load beam and the die pad to their initial material slug receiving positions.

With the above and other objects in view that will hereinafter appear, the nature of the invention will be more clearly understood by reference to the following detailed description, the appended claims, and the several views illustrated in the accompanying drawings.

In the drawings:

FIG. 1 is a schematic front elevational view of a press incorporating the stop mechanism of this invention.

FIG. 3 is a fragmentary vertical sectional view taken generally along the line 3—3 of FIG. 1, and shows the relationship of one of the stop bars with respect to the load beam.

Figure 2:
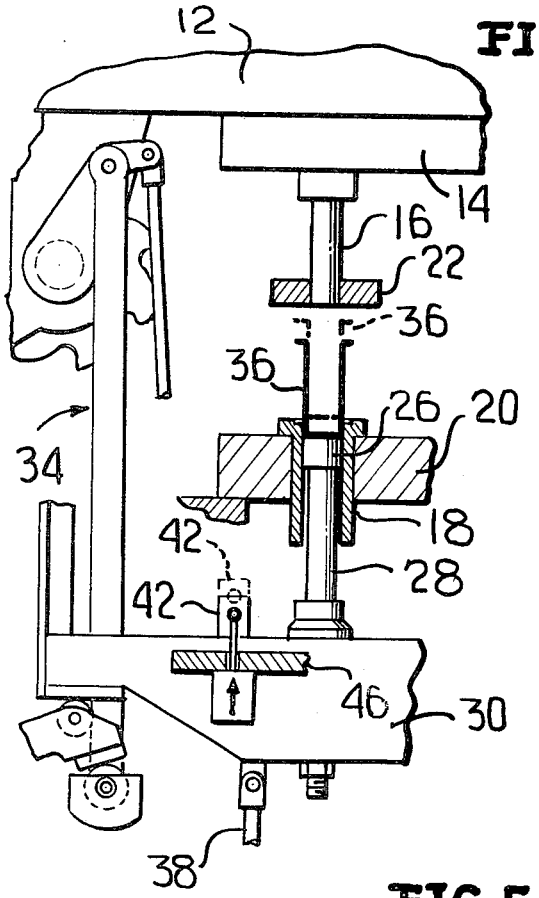
FIG. 2 is a fragmentary front elevational view showing one part only of the press subsequent to the forming of a tubular body.

Referring now to the drawings in detail, it will be seen that there is illustrated a press structure generally identified by the numeral 10. The press structure includes a ram 12 which is actuated by a rotary crank mechanism (not shown and not forming part of this invention) so as to reciprocate vertically in timed sequence. The ram 12 carries on its underside a mounting plate 14 which, in the illustrated form of the invention, carries a pair of depending punches 16. Each punch 16 is associated with a die sleeve 18 fixedly mounted in a suitable plate 20 forming part of the machine frame. There is associated with each punch a flange clamp 22 which, together with an enlargement 24 on the associated die sleeve 18, serves to close the upper end of a cavity into which the punch 16 projects.

There is mounted in the die sleeve 18 a die pad 26 which moves through the die sleeve 18 during a tubular body forming operation. Each die pad 26 is carried by a support rod 28 which, in turn, is suitably mounted on a load beam 30, the load beam 30 supporting all of the support rods 28.

In operation, a material slug 32 is placed in a cavity defined in the extreme upper part of each die sleeve 18 by the associated die pad 26 which is initially in a slightly recessed position. As the associated punch 16 moves downwardly, the flange clamp 22 engages the flange portion 24 to seal the slug 32 within the die cavity followed by the engagement of the slug by the punch so as to begin forging or extruding the slug. In FIG. 1, the punch has moved downwardly to effect an initial extrusion of the slug.

As each punch 16 continues downwardly, the associated die pad 26 is moved down through its die sleeve 18, thus moving the load beam 30 downwardly. In the press arrangement there is provided a coupling unit 34 which couples each end of the load beam 30 to the ram 12 in such a manner so as to pull the ram 12 downwardly and thus, in effect, squeeze the slug 32 between its associated punch 16 and die pad 26 while the slug moves downwardly with the punch and the die pad.

The die pads 26 and the load beam 30 move downwardly in unison for the full stroke of the punches 16 until such time as the desired tubular body 36 is formed. The punches 16 are then withdrawn, followed by the upward movement of the load beam 30 by a pair of extensible fluid units 38. Initially the load beam 30 was returned only to its starting position with the result that each die pad 26 remained recessed within its associated die sleeve 18 at the conclusion of the forming operation, as shown in solid lines in FIG. 2. However, in accordance with this invention it is proposed to move the load beam 30 further upwardly so as to move the formed tubular body 36 to its dotted line position of FIG. 2, at which time the die pad 26 is at least coplanar with the upper surface of the die sleeve 18. This results in the tubular body 36 being completely moved out of the die sleeve 18 and free to be moved transversely by a takeaway mechanism. This position of the load beam 30 and the die pad 26 is determined by duplicate stop mechanisms 40 on opposite sides of the load beam 30 as is generally shown in FIG. 1. Only one of these stop mechanisms will be described in detail here.

Figure 4:
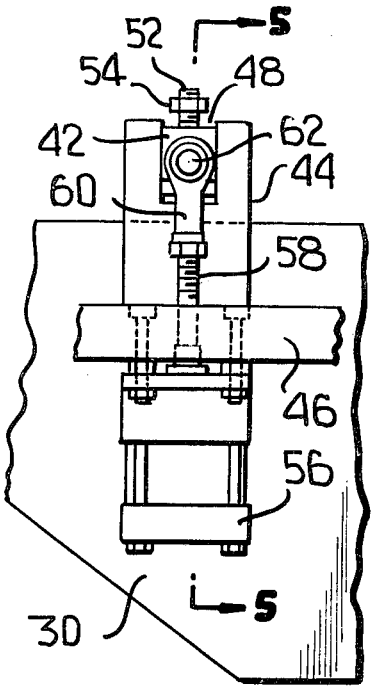
FIG. 4 is an enlarged fragmentary front elevational view showing the mounting of one end of a stop bar, the view being generally taken along the line 4—4 of FIG. 3.

Basically, each stop mechanism 40 includes a stop bar 42 which extends transversely of the load beam 30. The stop bar 42 has each end portion mounted within a combined guide and support 44 which is fixedly carried by a rigid frame portion 46. Each guide member 44 has a generally U-shaped upwardly opening notch 48 formed therein, as is best shown in FIG. 4, so as to facilitate guiding of the associated stop bar 42.

Figure 5:
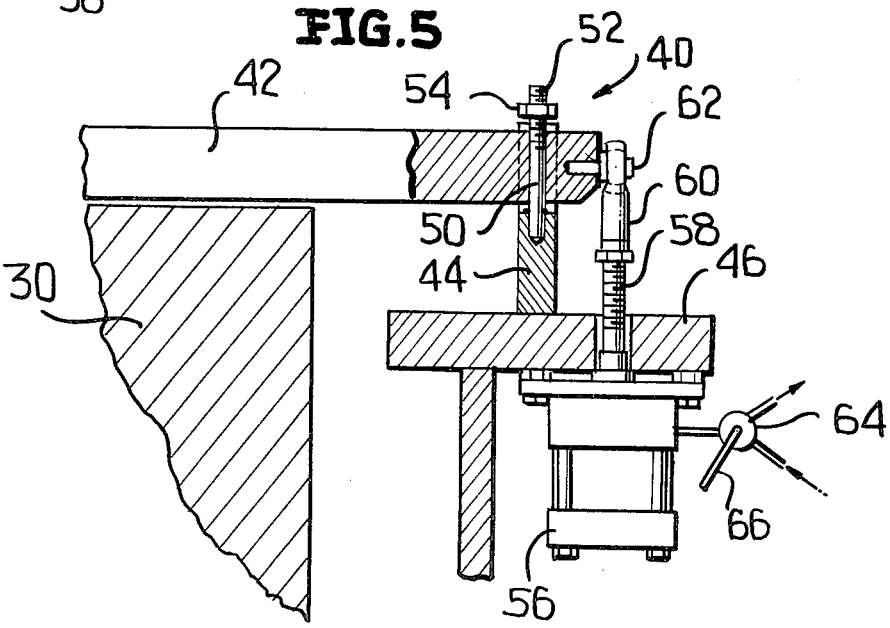
FIG. 5 is an enlarged fragmentary sectional view taken along the line 5—5 of FIG. 4, and shows specifically the details of the mounting of one end of the stop bar.

Each guide member 44 has extending upwardly through its associated notch a stop rod 50 which extends through the adjacent portion of the stop bar 42 as is shown in FIG. 5. Each stop rod 50 has an externally threaded upper portion 52 which carries a stop nut 54 which because of its threaded mounting is vertically adjustable.

It will be seen that when the load beam 30 is moved upwardly after the completion of the forming operation, it will engage the stop bar 42, but will not be stopped at that time by the stop bar. Instead, it lifts the stop bar 42 within the guide members 44 until the stop bar 42 engages the stop nuts 54. At this time the stop bar 42 temporarily becomes a fixed stop and prevents further upward movement of the stop bar 42 as well as the load beam 30. Thus this adjusted position of the stop bar 42 controls the uppermost position of the die pad 26.

It is to be understood that in order that the material slug 32 may be properly seated within the die sleeve 18 at the beginning of a new operation, the die pad 26 must be retracted to its initial starting position within the upper part of the die sleeve 18. In order accurately to accomplish this, each stop mechanism 40 has associated with opposite ends of the stop bar 42 an extensible fluid motor 56 which is mounted on a frame member 46 in a fixed position. Each fluid motor 56 is provided with a draw rod 58 (piston rod) which is adjustably threadedly connected to a fitting 60 which has a universal connection as at 62 with the adjacent end of the stop bar 42.

During substantially all of the operation of the press, the fluid motors 56 are not energized and thus do not restrict the upward movement of the stop bar 42 when engaged by the load beam 30. However, after the newly formed tubular body is removed, the fluid motors 56 are energized by way of a control valve 64 which may be driven from a motor control shaft 66 of the controller of the press. When the control valve 64 is suitably actuated, fluid under pressure is directed into the fluid motor 56 so as to effect the downward movement of the draw rod 58 for the full stroke of the fluid motor. At this time the stop bar 42 and the load beam 30 are drawn downwardly initially to position the load beam 30 and the die pad 26 for the beginning of the next forming operation.

Although normally each fluid motor 56 will be actuated the full extent thereof with the motor forming the stop for the final positioning of the stop bar 42, if desired the bottom of the notches 48 may be so positioned to function as the final stops for the stop bars 42.

It is to be understood that when the press is again actuated, the load beam 30 will move downwardly away from the stop bars 42 and thereafter the fluid motors 56 may be readily de-energized so as to permit the stop bars 42 to be moved upwardly once again during the return stroke of the load beam 30.

It will be readily apparent that the adjustments provided for and specifically illustrated in FIG. 5 are sufficient not only accurately to position the die pads 26 in their initiating positions, but also to facilitate the accurate displacement of the die pad upper surfaces out of the die sleeves so as to permit the proper ejection of the formed tubular bodies and the subsequent removal thereof.

Although only a preferred form of stop mechanism has been specifically illustrated and described herein, it is to be understood that minor variations may be made in the stop mechanism without departing from the spirit and scope of the invention as defined by the appended claims.

I claim:

1. In a press structure of the type for forming tubular bodies, said press structure including a fixed die sleeve, a die pad movable within said die sleeve, a punch mounted for reciprocation into and out of said die sleeve and for effecting movement of said pad within said die sleeve, and a movable support for said die pad; a stop mechanism cooperable with said movable support for positioning said die pad in a recessed position within said die sleeve for receiving a material slug to be formed and for permitting movement of said die pad to project axially beyond said recessed position for moving a formed tubular body out of said die sleeve.

2. The press structure of claim 1 wherein said stop mechanism includes at least one stop member having two positions, one corresponding to said die pad recessed position and the other corresponding to said die pad projecting position.

3. The press structure of claim 2 together with actuating means for moving said stop member from said other position to said one position.

4. The press structure of claim 2 together with actuating means for moving said stop member from said other position to said one position while said stop member is in engagement with said support.

5. The press structure of claim 3 wherein said actuating means is in the form of at least one extensible fluid motor.

6. The press structure of claim 3 wherein said actuating means is in the form of at least one extensible fluid motor, and there are control means for actuating said fluid motor.

7. The press structure of claim 2 together with at least one stop element limiting movement of said stop member to said other position.

8. The press structure of claim 7 wherein said stop element is adjustable.

9. The press structure of claim 1 wherein said stop mechanism includes at least one stop bar extending transversely of said support, means mounting remote portions of said stop bar for guided limited movement by said support, and extensible fluid motors coupled to said bar on opposite sides of said support for moving said support from a formed tubular body dispensing position to said material slug receiving position.

10. The press structure of claim 9 together with control means for actuating said fluid motors.

* * * * *